US009236684B2

(12) United States Patent
Lin

(10) Patent No.: US 9,236,684 B2
(45) Date of Patent: Jan. 12, 2016

(54) CABLE INTERFACE CONNECTION STRUCTURE

(71) Applicant: CyberTAN Technology, Inc., Hsinchu (TW)

(72) Inventor: Yueh-Feng Lin, Hsinchu (TW)

(73) Assignee: CyberTAN Technology, Inc., Hsinchu (TW)

( * ) Notice: Subject to any disclaimer, the term of this patent is extended or adjusted under 35 U.S.C. 154(b) by 27 days.

(21) Appl. No.: 14/185,152

(22) Filed: Feb. 20, 2014

(65) Prior Publication Data

US 2015/0194775 A1 Jul. 9, 2015

(30) Foreign Application Priority Data

Jan. 9, 2014 (TW) ..... 103100756 A

(51) Int. Cl.

| | |
|---|---|
| ***H01R 13/627*** | (2006.01) |
| ***H01R 24/64*** | (2011.01) |
| *H01R 12/70* | (2011.01) |
| *H01R 12/72* | (2011.01) |
| *H01R 31/00* | (2006.01) |

(52) U.S. Cl.

CPC ..... *H01R 13/6273* (2013.01); *H01R 24/64* (2013.01); *H01R 12/7023* (2013.01); *H01R 12/724* (2013.01); *H01R 31/005* (2013.01)

(58) Field of Classification Search

CPC ..... H01R 23/025; H01R 23/7073; H01R 23/005; H01R 23/02

See application file for complete search history.

(56) References Cited

U.S. PATENT DOCUMENTS

| | | | | |
|---|---|---|---|---|
| 3,963,300 | A * | 6/1976 | Patton et al. | 439/638 |
| 4,368,942 | A * | 1/1983 | Mathe et al. | 439/676 |
| 6,544,706 | B1 * | 4/2003 | Takasaki | 430/110.2 |
| 6,585,540 | B2 * | 7/2003 | Gutierrez et al. | 439/620.19 |
| 6,592,397 | B2 * | 7/2003 | Pocrass | 439/418 |
| 6,796,844 | B1 * | 9/2004 | Edwards, III | 439/638 |
| 2010/0267282 | A1 * | 10/2010 | Tsai | 439/607.17 |
| 2013/0130549 | A1 * | 5/2013 | Wu et al. | 439/607.01 |
| 2013/0149913 | A1 * | 6/2013 | Sun et al. | 439/676 |
| 2015/0064979 | A1 * | 3/2015 | Yang | 439/676 |

FOREIGN PATENT DOCUMENTS

| | | |
|---|---|---|
| CN | 202050073 | 11/2011 |

* cited by examiner

*Primary Examiner* — Gary Paumen

(74) *Attorney, Agent, or Firm* — Novak Druce Connolly Bove + Quigg LLP

(57) ABSTRACT

A cable interface connection structure includes a jack and a plug. The plug is received in the jack. The jack includes a case, a support body, and a plurality of pins. The pins are received in the support body, and the support body is received in the case. The jack defines two rows of the pins. The plurality of pins in each row is the same. The plug includes two rows of contact terminals. A plurality of contact terminals in each row is the same. The pins are coupled to the contact terminals.

10 Claims, 12 Drawing Sheets

CABLE INTERFACE CONNECTION STRUCTURE

BACKGROUND

1. Technical Field

The present disclosure relates to a communication interface connection structure, and more particularly to a cable interface connection structure.

2. Description of Related Art RJ45 ports are commonly used for data transmission in network interfaces. One RJ45 port connects to one cable. Thus, two or more RJ45 ports are required to connect to two or more cables. However, space of the network interfaces may be too limited to add more RJ45 ports.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
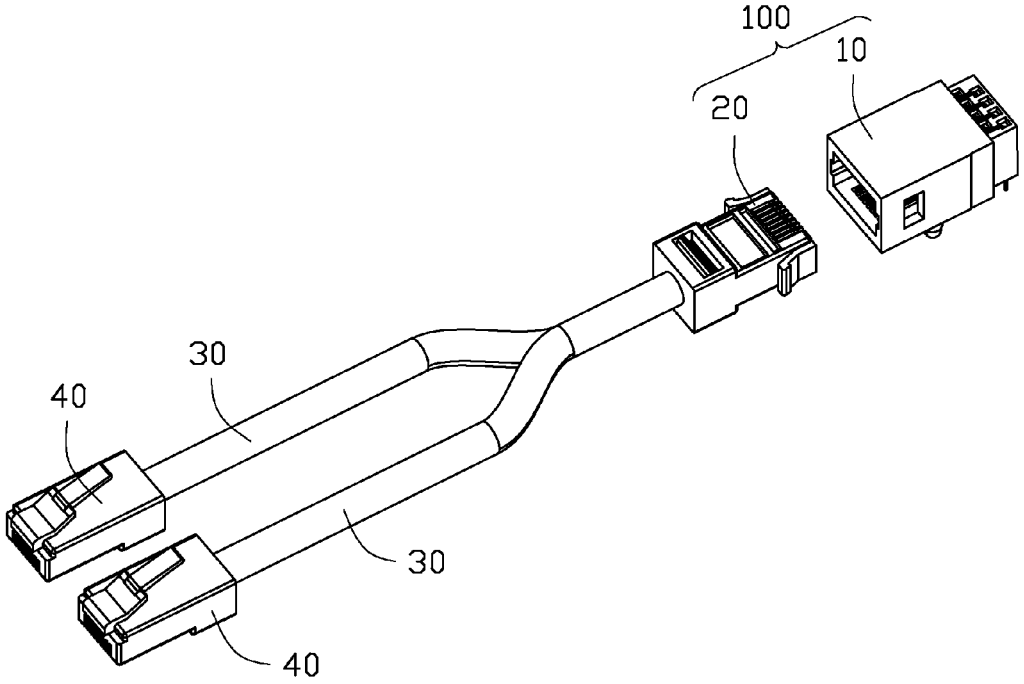
FIG. 1 is an isometric view of an embodiment of a cable interface connection structure.

The disclosure is illustrated by way of example and not by way of limitation in the figures of the accompanying drawings in which like reference numerals indicate the same or similar elements. It should be noted that references to "an" or "one" embodiment in this disclosure are not necessarily to the same embodiment, and such references can mean "at least one."

Figure 2:
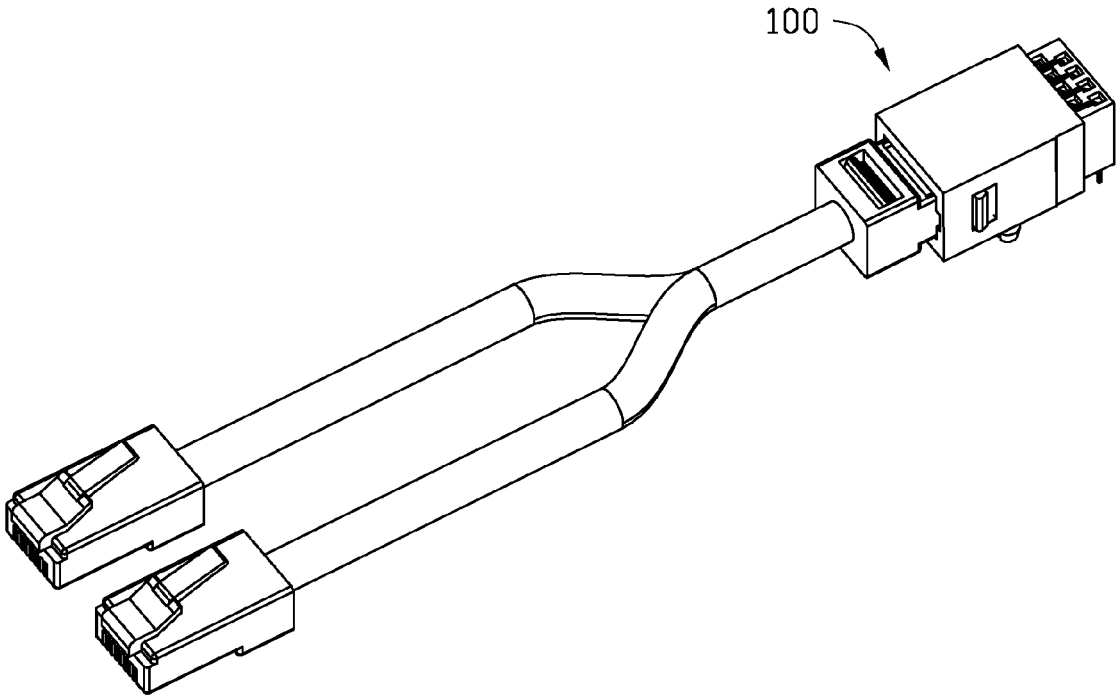
FIG. 2 is an isometric view of a plug received in a jack of the cable interface connection structure of FIG. 1.

FIGS. 1 and 2 show that a cable interface connection structure 100 includes a jack 10 and a plug 20. The plug 20 is inserted into the jack 10. In the embodiment, the plug 20 connects to two cables 30. An end portion of each cable 30 connects to a crystal head connector 40.

Figure 3:
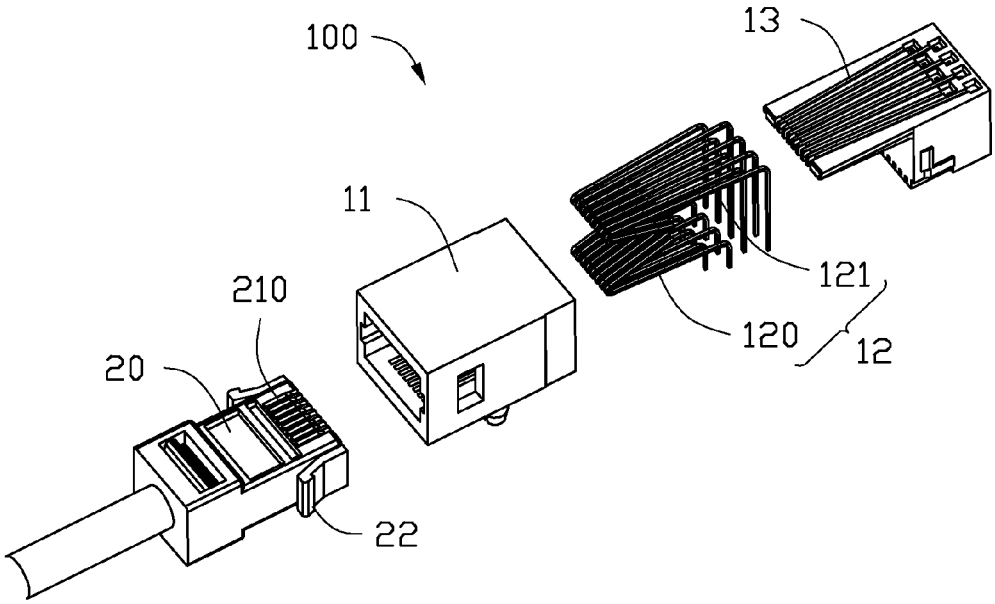
FIG. 3 is an exploded, isometric view of the cable interface connection structure of FIG. 1.
Figure 4:
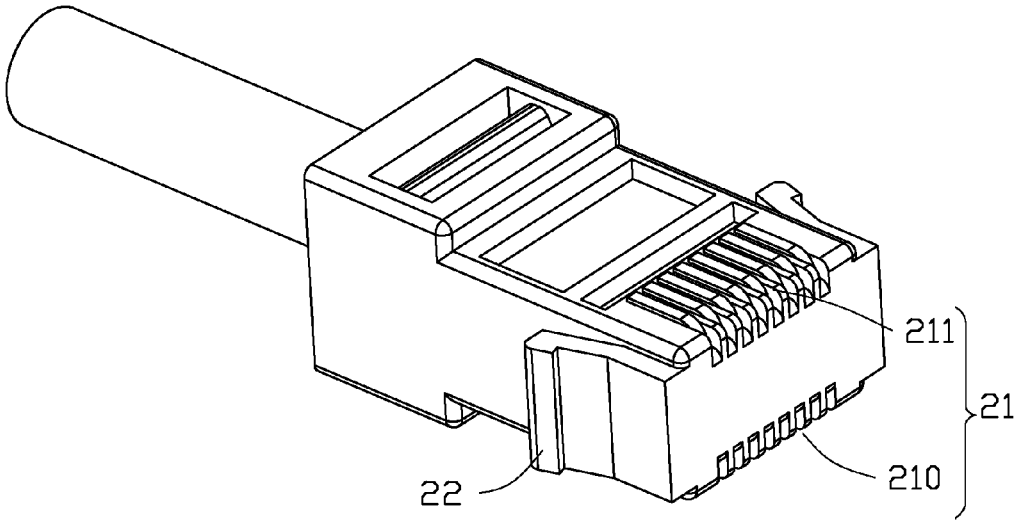
FIG. 4 is an isometric view of the plug of FIG. 2.

FIGS. 3 and 4 show that the plug 20 includes a contact head 21 and two elastic hooks 22. The contact head 21 defines a first contact terminal group 210 and a second contact terminal group 211. The first contact terminal group 210 and the second contact terminal group 211 each include eight contact terminals. The two elastic hooks 22 are located at two sides of the contact head 21.

The jack 10 includes a case 11, a plurality of pins 12 and a support body 13. The plurality of pins 12 and the support body 13 are received in the case 11.

Figure 5:
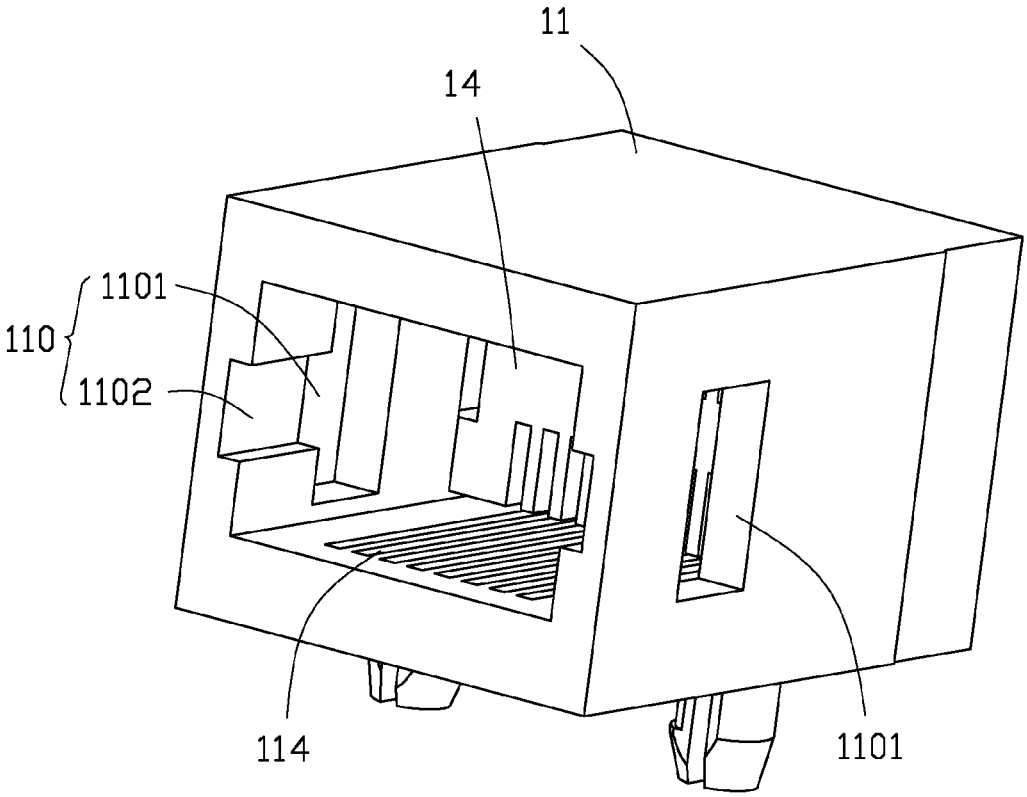
FIG. 5 is an isometric view of a case of the jack of FIG. 2.
Figure 6:
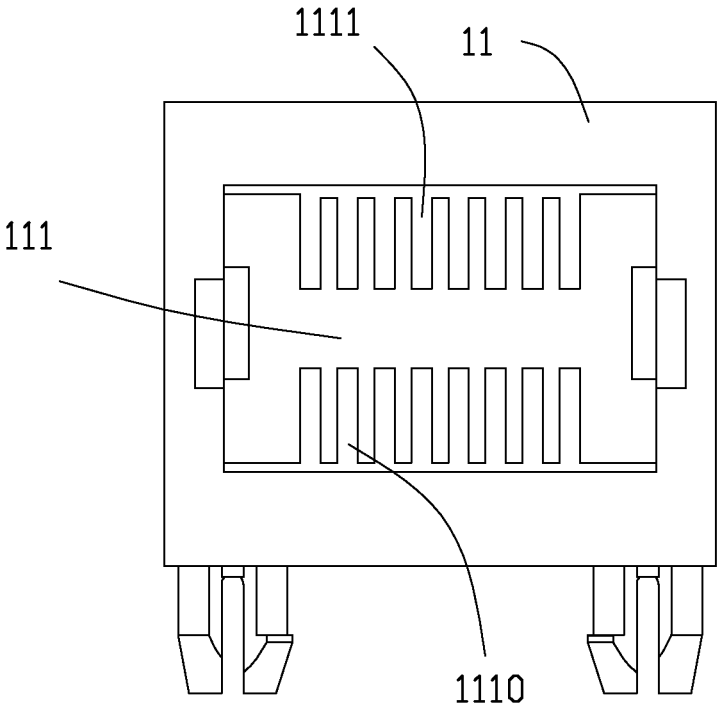
FIG. 6 is a front view of the case of FIG. 5.
Figure 7:
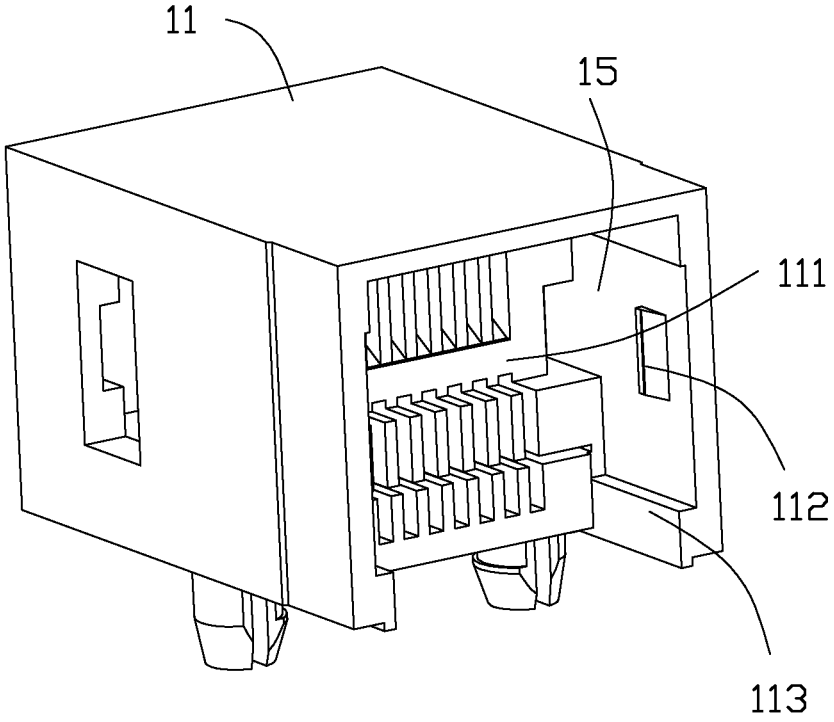
FIG. 7 is another isometric view of the case of FIG. 5.

FIGS. 5 through 7 show that the case 11 defines two connecting spaces 110, and includes a slot board 111, a plurality of first hooks 112, and flanges 113. The two connecting spaces 110 are defined in two opposite sides of the case 11. The connection space 110 is divided into a square hole 1101 and a groove 1102 communicating with the square hole 1101. The slot board 111 is received in the case 11 and drives an inner space of the case 11 into a first space 14 and a second space 15. A second groove group 114 communicating with the first space 14 is defined in the case 11. The slot board 111 includes a first slot group 1110 and a second slot group 1111. The plurality of first hooks 112 and the flanges 113 are located at two sides of the case 11.

Figure 8:
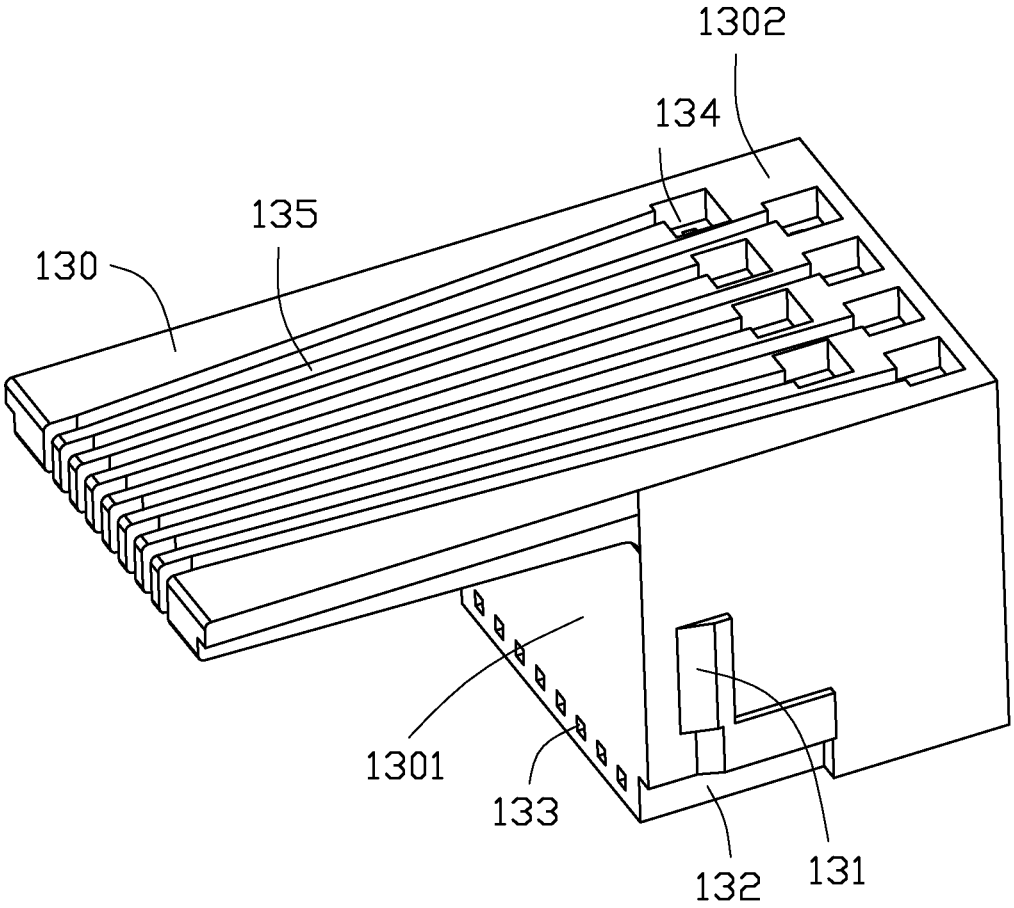
FIG. 8 is an isometric view of a support body of the jack of FIG. 2.
Figure 9:
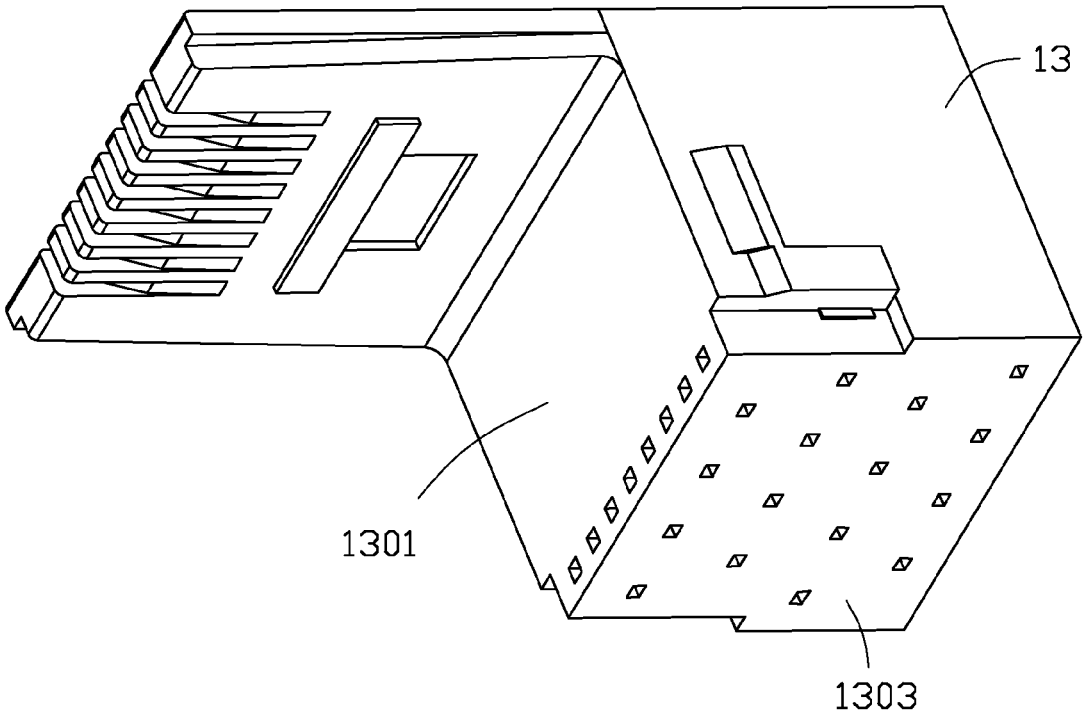
FIG. 9 is another isometric view of the support body of FIG. 8.

FIGS. 8 and 9 show that the support body 13 includes a plurality of second hooks 131 and defines two support grooves 132, eight first holes 133, eight second holes 134, a first groove group 135. The second hook 131 engages with the first hook 112, and the flanges 113 are located on the support grooves 132, to securely receive the support body 13 in the second space 15 of the case 11.

The support body 13 further includes a first surface 1301, a second surface 1302, a third surface 1303, and a block 130. The first groove group 135 is defined in the second surface 1302. The block 130 is substantially coplanar with the second surface 1302 and extends from the first surface 1301. The eight first holes 133 are defined in the first surface 1301 and adjacent to the third surface 1303. The eight second holes 134 are defined at one end of the first groove group 135. Each of the eight first holes 133 and each of the eight second holes 134 communicate with respective holes defined in the third surface 1303.

Figure 10:
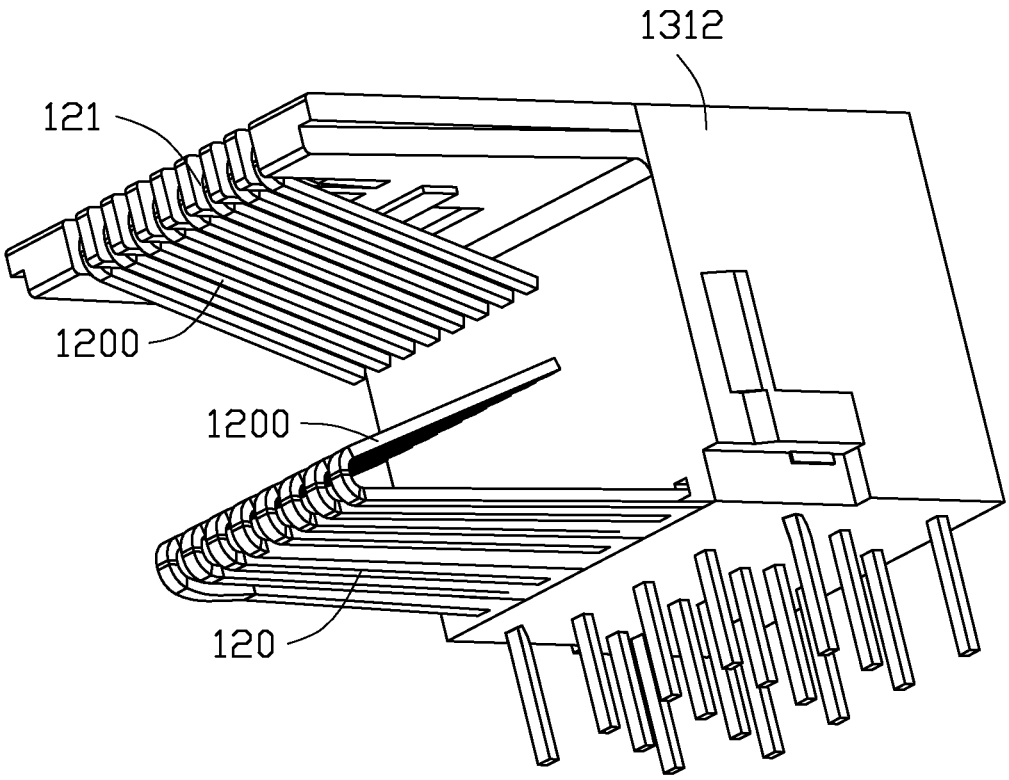
FIG. 10 is an isometric view of pins assembled to the support body of FIG. 8.
Figure 11:
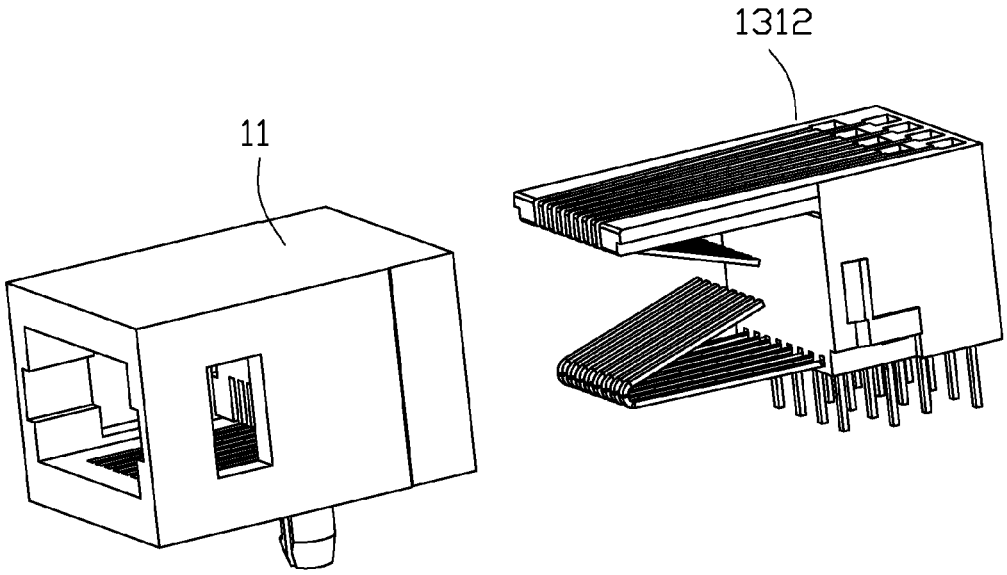
FIG. 11 is an isometric view of the case and the support body with the pins of FIG. 8.
Figure 12:
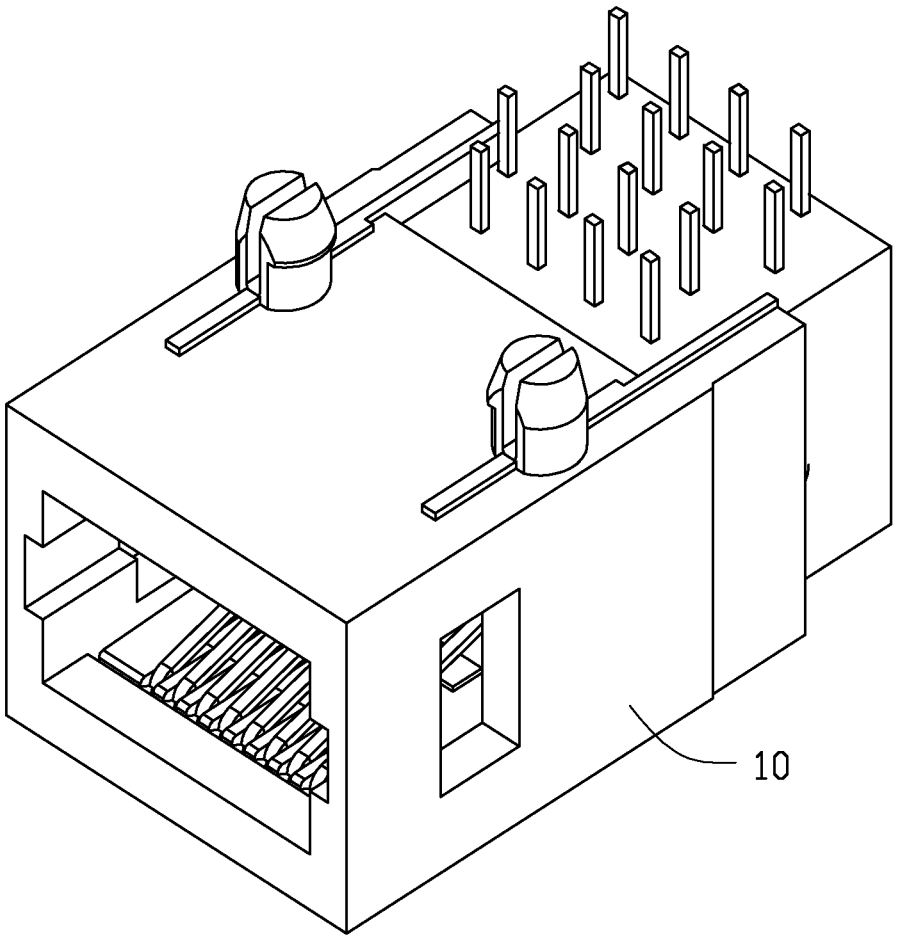
FIG. 12 is an isometric view of the jack of FIG. 2.

FIGS. 10 through 12 show that the plurality of pins 12 are divided into a first pin group 120 and a second pin group 121. The first pin group 120 and the second pin group 121 each include eight pins. Each of the plurality of pins 12 includes an elastic contact head 1200. The first pin group 120 extends through the corresponding eight first holes 133 and the eight holes defined on the third surface 1303. The second pin group 1221 is received in the first groove group 135, and extends through the eight corresponding second holes 134 and the eight corresponding holes defined in the third surface 1303.

In assembly of the cable interface connection structure 100, the pins 12 and the support body 13 are received in the second space 15 of the case 11. Then, the first group 120 is received in the first slot group 1110, and further received in the first space 14 and the second groove group 114. The second pin group 121 is received in the second slot group 1111, and further received in the second space 15. The first hooks 112 engage with the second hooks 131.

The plug 20 is received in the first space 14. The elastic hooks 22 engage with the connecting spaces 110 when the plug 20 is completely received in the first space 14, thus fixing the plug 20 in the first space 14. The first pin group 120 is coupled to the first contact terminal group 210, and the second pin group 121 is coupled to the second contact terminal group 211.

In the embodiment, the first contact terminal group 210 corresponds to one cable 30, and the second contact terminal group 211 corresponds to the other cable 30. Thus only one jack is needed for the two cables 30.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A cable interface connection structure, comprising:

a jack comprising a case, a support body and a plurality of pins, the pins being received in the support body, the support body being received in the case; and a plug received in the jack, the plug comprising a plurality of contact terminals;

wherein the jack comprises two rows of the pins, the plurality of pins in each row is the same, the plug comprises two rows of the contact terminals, the plurality of contact terminals in each row is the same, and the pins are coupled to the contact terminals;

wherein the case comprises a slot board driving an inner space of the case into a first space and a second space, the plug is received in the first space and the support body is received in the second space.

2. The cable interface connection structure of claim 1, wherein the plug comprises a contact head and two elastic hooks located at two sides of the contact head, wherein the case comprises two connection spaces, the two hooks engage with the two connection spaces.

3. The cable interface connection structure of claim 2, wherein the connecting space is divided into a square hole and a groove communicating with the square hole.

4. The cable interface connection structure of claim 1, wherein the two rows pins comprise a first pin group and a second pin group, and the two rows contact terminals comprise a first contact terminal group coupled to the first pin group, a second contact terminal group coupled to the second pin group.

5. The cable interface connection structure of claim 4, wherein the first pin group and the second pin group each comprise eight pins, and the first contact terminal group and the second contact terminal group each comprise eight contact terminals.

6. The cable interface connection structure of claim 1, wherein the support body comprises eight first holes defined in a first surface, eight second holes defined in a second surface and a first groove group, wherein each of the eight first holes and each of the eight second holes communicate with respective holes defined in a third surface.

7. The cable interface connection structure of claim 6, wherein the first groove group is defined in the second surface and a block substantially coplanar with the second surface and extended from the first surface, the pins of the first pin group extending through the eight first holes defined in the first surface, the pins of the second pin group extending through the eight second holes defined in the second surface.

8. The cable interface connection structure of claim 1, wherein the slot board comprises a first slot group and a second slot group, the pins of the first pin group received in the first slot, the pins of the second pin group received in the second slot group.

9. The cable interface connection structure of claim 1, wherein the first space comprises a groove group communicating with the first space is defined in the case.

10. The cable interface connection structure of claim 1, wherein the case further comprises a first hook and a flange, and the support body further comprises a second hook and a support groove, the first hook engaging with the second hook, the flange being received in the supporting groove to securely retain the support body in the case.

* * * * *